US006280286B1

(12) United States Patent
Andrews

(10) Patent No.: US 6,280,286 B1
(45) Date of Patent: Aug. 28, 2001

(54) TOY FIGURE PAIR SIMULATING COMBAT

(75) Inventor: Michael Andrews, Los Angeles, CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/497,456

(22) Filed: Feb. 3, 2000

(51) Int. Cl.[7] ..... A63H 13/06

(52) U.S. Cl. ..... 446/334; 446/335; 446/336; 446/269; 446/279

(58) Field of Search ..... 446/269, 279, 446/333, 334, 335, 336

(56) References Cited

U.S. PATENT DOCUMENTS

| | | | |
|---|---|---|---|
| 569,333 | * | 10/1896 | Hinckley . |
| 1,458,683 | * | 6/1923 | Carlin . |
| 1,552,314 | * | 9/1925 | Kohl . |
| 2,088,510 | | 7/1937 | Frasca . |
| 2,623,329 | | 12/1952 | Leva . |
| 2,741,870 | | 4/1956 | Lang . |
| 3,874,112 | | 4/1975 | Sapkus et al. . |
| 4,091,563 | * | 5/1978 | Noble et al. . |
| 4,457,097 | | 7/1984 | Miller et al. . |
| 4,526,552 | | 7/1985 | Rhodes . |
| 4,536,166 | | 8/1985 | Renger et al. . |
| 4,673,367 | | 6/1987 | MacBain . |
| 4,995,610 | | 2/1991 | Paoletti . |
| 5,042,807 | | 8/1991 | Sasakawa et al. . |
| 5,046,987 | | 9/1991 | Djordjevic . |
| 5,087,219 | | 2/1992 | Price . |
| 5,727,982 | * | 3/1998 | Hurt ..... 446/352 |

* cited by examiner

*Primary Examiner*—Jacob K. Ackun, Jr.
*Assistant Examiner*—Bena B Miller
(74) *Attorney, Agent, or Firm*—Roy A. Ekstrand

(57) ABSTRACT

A toy figure pair includes an assault toy figure having a punching mechanism which extends the toy figure arms in a punching or attacking movement as the user manipulates a movable toggle at the toy figure rear torso surface. A target toy figure is movably supported upon a plurality of freely rolling wheels and is able to roll away from impacts received from the assault toy figure. Additionally, a resilient cape supported upon the target toy figure is able to prevent tipping of the target toy figure under certain circumstances.

1 Claim, 2 Drawing Sheets

TOY FIGURE PAIR SIMULATING COMBAT

FIELD OF THE INVENTION

This invention relates generally to toy figures and particularly to those which include movement features for simulating combat.

BACKGROUND OF THE INVENTION

Toy figures which include movement features such as the ability to have appendages or other body portions moved in response to user input are well known in the art. Notsurprisingly, practitioner's in the art have developed a virtually endless variety of articulated toy figures having movement capabilities. One particularly successful movement feature toy figure was known generally in the market place under the name "Rockem Sockem Robot Game". The basic features of this game included a pair of virtually identical robot-like toy figures, each of which included a head movable between a raised or extended position and a normal position. A spring latch mechanism within the toy figure allowed the head to be pushed downwardly upon the body against the force of the internal spring and latched by moving the head forward. In response to an impact to the toy robot head, the latch mechanism released and the head of the figures rose abruptly. Each robot figure also included a pair of pivotally supported arms coupled to an internal gear mechanism and a toggle button on the toy figures back torso surface. The pivotal arms were coupled to the rear toggle button by a gear drive mechanism. In its anticipated play activity, each user grasped one of the toy robots in a manner enabling the manipulation of the rear toggle button with the object of moving the pivotal arms against the opponent so-as-to strike a blow to the head of the opponents robot. In response to a sufficient blow to the head particularly from the front, latch released and the head sprung upwardly.

Still other toy figures with movement capability have been provided which are generally directed to activities such as combat, boxing or the like. For example, U.S. Pat. No. 5,046,987 issued to Djordjevic sets forth TOY BOXER ARMS for use on a doll having a torso. Each arm is pivotally supported by an inwardly extending shaft which in turn is coupled to a spring support. A pair of pivotally supported levers are coupled to the shaft supporting the arms by a flexible string or the like. Movement of each lever moves the dolls arms.

U.S. Pat. No. 4,457,097 issued to Miller et al. sets forth an ACTION TOY AND GAME having a hand-grip handle which supports a multiply articulated extendible member and which includes a thumb receiving end proximate the user. The outer end of the multiply articulated member is supported within a hand puppet. The movement of the user's thumb against the thumb piece of the multiply articulated member causes the puppets arms to move.

U.S. Pat. No. 4,995,610 issued to Paoletti sets forth an ELECTRIC BOXING GAME having two opposed doll boxers movably mounted on a support surface. Each boxer has swingable arms and a punch received indicator. Electric or computer control means operate at least one boxer so-as-to provide body movement and arm movements against the other boxer.

U.S. Pat. No. 2,088,510 issued to Frasca sets forth a TOY having a pair of puppet-like dolls supporting articulated arms and moveable upon a play surface. A downwardly extending member passes through apertures in the play surface and is coupled to a pistol grip-like handle suitable for grasping by each of the opposed players. The players manipulate their respective dolls and implement blows by squeezing the trigger mechanism on the handle to move the arms of the doll.

U.S. Pat. No. 2,623,329 issued to DiLeva sets forth an EXTENSIBLE DOLL having arm and leg appendages which include telescoping extendible members.

U.S. Pat. No. 2,741,870 issued to Lang sets forth a GROWING FIGURE TOY having a soft extendible outer body supported by an extendible internal frame. As the frame extends, the body is stretched and the toy appears to "grow".

U.S. Pat. No. 3,874,112 issued to Sapkus et al. sets forth an ANIMATING DEVICE FOR FIGURE TOYS having a pistol-like hand grip which is swingably connected to a figure toy. The figure toy may be moved in a swinging fashion to simulate baseball hitting or other similar activities.

U.S. Pat. No. 4,526,552 issued to Rhodes sets forth an ANIMATED FIGURE TOY HAVING A TELESCOPING APPENDAGE which includes an upper torso provided with a neck opening. An elongated neck and head assembly are received within the opening and reciprocate to move the head relative to the torso.

U.S. Pat. No. 4,536,166 issued to Renger et al. sets forth a CAP FIRING ANIMATED FIGURE TOY having positionable appendages and upper and lower torso portions pivotally interconnected with a spring member. The rear of the torso is configured for retaining sound emitting devices such as a plurality of caps and a mechanism including a spring biased hammer member is provided within the torso for actuating one of the caps.

U.S. Pat. No. 4,673,367 issued to MacBain sets forth an ANIMATED FIGURE TOY having an upper torso with a trunnion member coupled for rotatable movement. The trunnion includes hinge couplers connectable to mating hinge portions on the interior of the front and rear halves of the upper torso. A spring is positioned beneath the trunnion for co-action with an actuating post sliding captively within the trunnion for limited movement.

U.S. Pat. No. 5,042,807 issued to Sasakawa et al. sets forth an BOXER DOLL AND BOXING GAME APPARATUS EMPLOYING SAME having a base upon which a pair of boxing figures are supported. A pneumatic mechanism is supported within each of the figures which is operative to move the boxers arms in a punch-like action. The pneumatic mechanisms within each doll are operated by a pair of squeezable bulbs held by the participants.

U.S. Pat. No. 5,087,219 issued to Price sets forth an ACTION CHARACTER FIGURE which includes a torso portion, a rotatable arm portion on the torso and a leg portion which is retractable into the lower end of the torso. The arm is connected to the leg in the interior of the torso such that rotation of the arm causes the leg portion to be retracted into the torso against the force of an internal spring. Release of the spring causes the arm to be rotated in a reverse direction and the leg to be resiliently extended.

While the foregoing prior art devices to some extent improved the art and have in some instances enjoyed commercial success, there remains nonetheless a continuing need in the art for ever more interesting, amusing and entertaining articulated toy figures having movement capability.

SUMMARY OF THE INVENTION

Accordingly, it is a general object of the present invention to provide an improved toy figure game. It is a more particular object of the present invention to provide an improved toy figure game having a toy figure pair for simulating combat. It is a still more particular object of the present invention to provide an improved toy figure game having a toy figure pair in which one of the toy figures is movable laterally in response to a punch impact.

In accordance with the present invention there is provided a combat simulating toy figure pair comprising: a first figure having a first torso, a first head, a first pair of arms and a first pair of legs, the first torso defining a slot therein; arm moving means supported within the first torso having a toggle rotatably supported in the first torso having a gear portion, a pair of shafts supporting the first pair of arms, and gear means coupling the gear portion to the arm shafts; a second figure having a second torso, a second head, a second pair of arms and a body support supporting the torso; a wheel plate supporting the body support and defining a plurality of slots; and a plurality of wheels rotatably supported within the slots, the first figure being manipulated by moving the toggle to punch the second figure and the second figure receiving a punch from the first figure and rolling away from the first figure.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
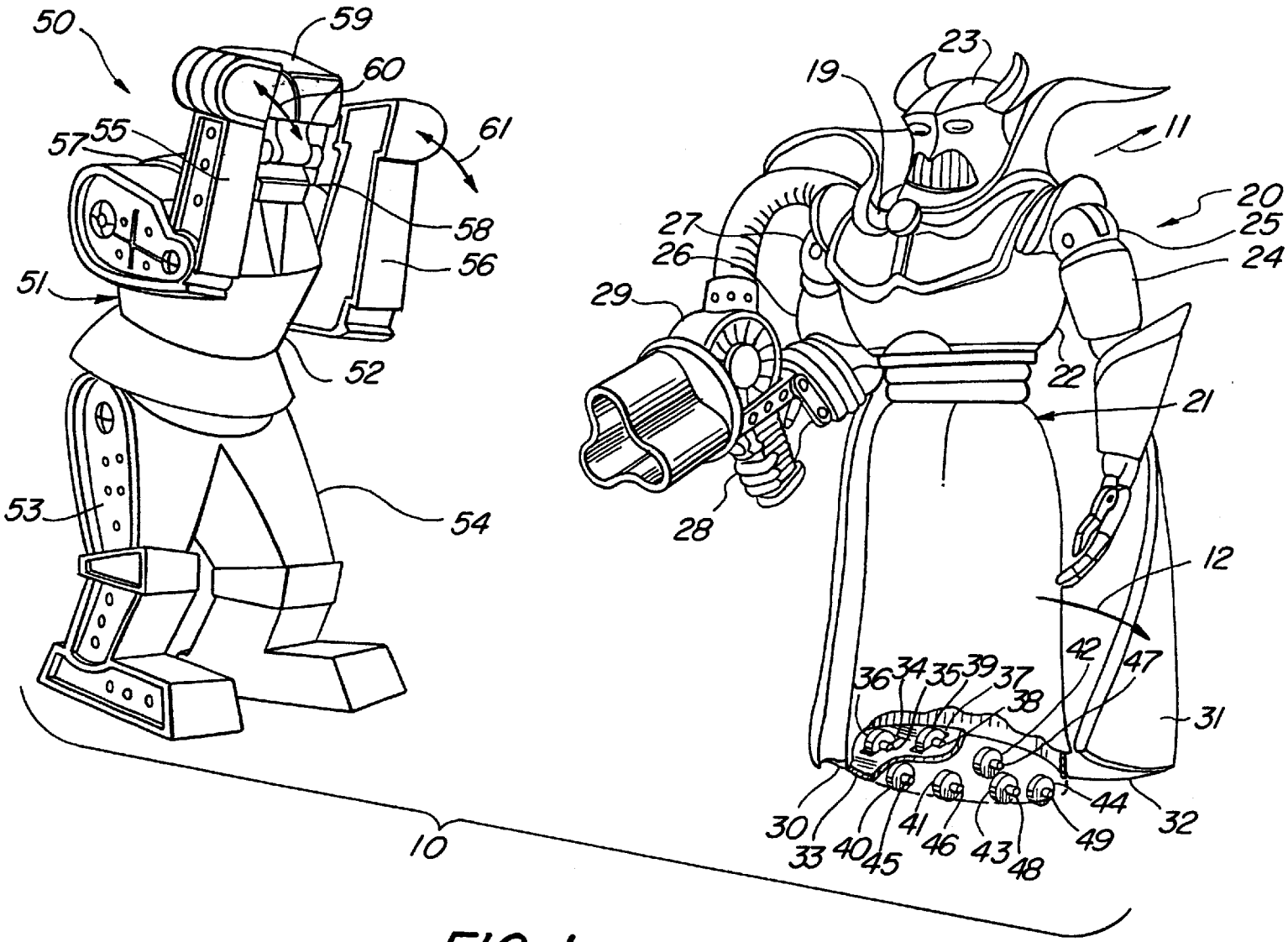
FIG. 1 sets forth a perspective view of a toy figure pair constructed in accordance with the present invention.

FIG. 1 sets forth a perspective view of a toy figure pair constructed in accordance with the present invention and generally referenced by numeral 10. Toy figure pair 10 includes a target toy figure 20 cooperating with an assaulting toy figure 50. Toy figure 20 generally resembles a fanciful creation of a wizard or the like while toy figure 50 generally resembles a fanciful robot or the like. In the anticipated play pattern of toy figure pair 10, toy figure 50 is moved against toy figure 20 in an assault move which is carried forward by a series of punching actions by toy figure 50 in the manner described below. Toy figure 20 is supported by a plurality of rotating wheels such that toy figure 20 is readily adapted to absorb punch impacts and move rearwardly or roll away from toy figure 50. Additionally, toy figure 20 utilizes a resilient cape for additional support against tipping in response to punch actions.

More specifically, toy figure 20 includes a body 21 generally simulating a fanciful wizard or the like and having a torso 22 supporting a head 23 and a pair of arms 24 and 26. Body 21 further includes a pair of shoulder joints 25 and 27 pivotally supporting arms 24 and 26 respectively upon torso 22.

In accordance with an important aspect of the present invention, body 21 further includes a downwardly extending body support 30 having a wheel plate 33 on the bottom surface thereof. Wheel plate 33 defines a plurality of elongated slots such as slots 34 and 37. A plurality of freely rolling wheels, such as wheels 36 and 39 are rotatably supported upon wheel plate 33 within slots 34 and 37 by axles 35 and 38 respectively. An additional plurality of wheels 40 through 44 are similarly supported upon wheel plate 33 by respective axles 45 through 49.

Toy figure 20 further includes a resilient cape 31 supported upon body 11 by a neck ring portion 19 which generally encircles head 23. Resilient cape 31 is preferably formed of a resilient relatively stiff material such as rubber or soft plastic and defines a bottom edge 32. Bottom edge 32 is close to touching the supporting surface upon which wheels 36, 39 and 40 through 44 rollingly support toy figure 20. However, in the preferred fabrication of the present invention, edge 22 is spaced somewhat distant from body support 30 and is close to but not touching the underlying support surface upon which toy figure 20 is freely rolling. In this manner, resilient cape 31 provides support for toy figure 20 in the event toy figure 20 is impacted by punches from toy figure 50 in the manner described below and would other wise to tilt rearwardly in the direction indicated by arrow 12. Such tilting is resisted as edge 32 comes in contact with the surface upon which toy figure 20 is rolling.

Toy figure 50 includes a body 51 supported by a pair of legs 53 and 54 and having a pair of arms 55 and 56. Body 51 further includes a head 59. Arms 55 and 56 are pivotally supported upon torso 52 of body 51 at a pair of shoulder joints 57 and 58. In accordance with the mechanism set forth below in greater detail, arms 55 and 56 are pivotally movable forward and rearwardly in the directions indicated by arrow 60 in a punching motion which is intended to simulate combat as toy figure 50 assaults toy figure 20. Suffice it to note here, that toy figure 50 may be held by the user and moved against toy figure 20 in an attack or assault. Suffice it further to note that as the user moves toy figure 50 against toy figure 20, the user causes punching motions by arms 55 and 56 hoping to land a blow against toy figure 20 sufficient to tip it or knock it over.

During the above described simulation of combat, as toy figure 50 assaults toy figure 20 the novel support of toy figure 20 upon a plurality of rolling wheels together with the assistance of resilient cap 31 cooperate to allow toy figure 20 to sustain such impacts and thereby survive attack by toy figure 50.

Figure 2:
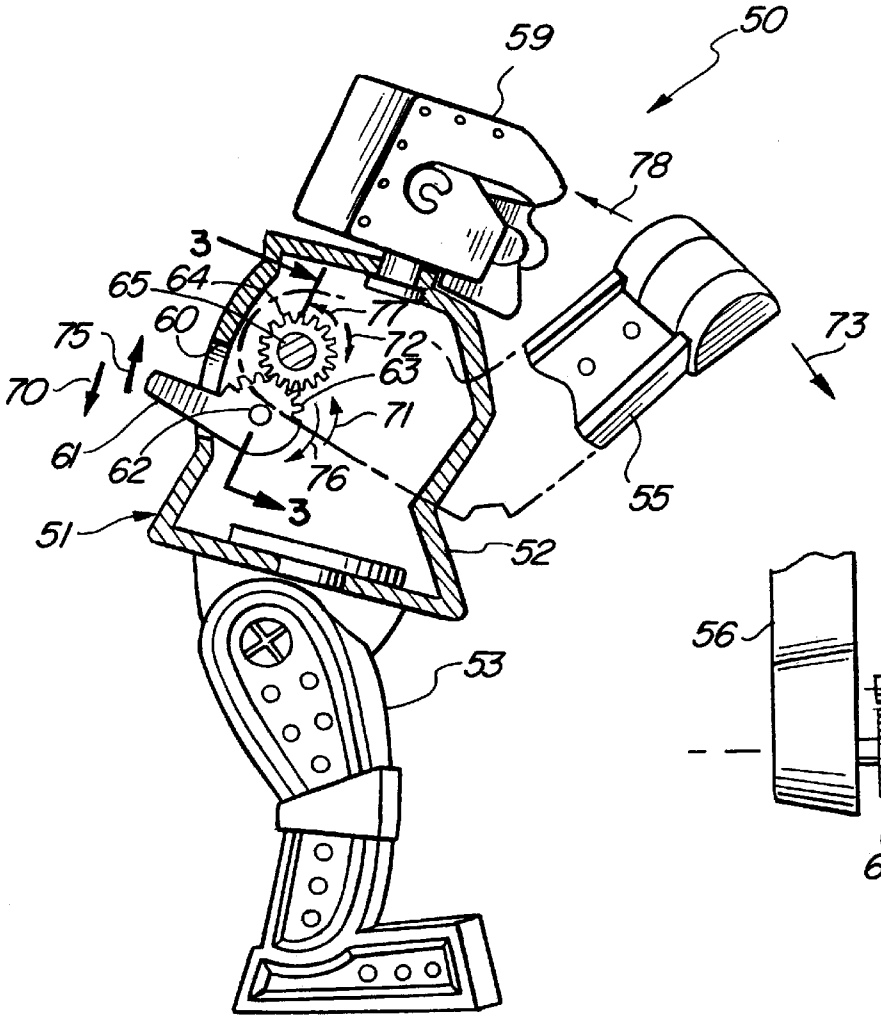
FIG. 2 sets forth a partial section side view of one of the toy figures of the present invention toy figure pair.

FIG. 2 sets forth a partial section view of toy figure 50. As described above, a number of toy figures have been provided in the prior art which simulate a punching or boxing-type action. Accordingly, it will be understood that toy figure 50 may be fabricated entirely in accordance with the conventional fabrication of prior art punching or boxing dolls and toy figures. For example, toy figure 50 in its preferred fabrication is substantially similar to the above described prior art device utilized in the prior art game known as "Rockem Sockem Robot Game". Alternatively, virtually any conventional punching or boxing toy figure capable of extending or pivoting one or more arms in a punching action to impact toy figure 20 (seen in FIG. 1) may be utilized for toy figure 50 without departing from the spirit and scope of the present invention.

More specifically, toy figure 50 includes a body 51 having a torso 52 supporting a head 59. Torso 52 is supported by a pair of legs 53 and 54 (leg 54 shown in FIG. 1). A pair of arms 55 and 56 (arm 56 seen in FIG. 1) are pivotally supported upon torso 52.

Toy figure 50 further includes a toggle 61 supported by a shaft 62 within torso 52. Toggle 61 extends rearwardly through a slot 60 formed at the rear surface of torso 52. A shaft 65 is rotatably supportive within torso 52 by conventional support means (not shown). Shaft 65 supports a gear 64 which engages gear portion 63 of toggle 61. As is better seen in FIG. 3, shaft 65 supports arm 55 and is rotatable therewith.

In operation, a punching action is produced as the user moves toggle 61 within slot 60 in which arm 55 (as well as arm 56 shown in FIG. 3) pivot in response to movement of toggle 61. Thus, as the user moves toggle 61 downwardly in the direction indicated by arrow 70, gear portion 63 rotates in the direction indicated by arrow 71 which in turn rotates gear 64 and shaft 65 in the direction indicated by arrow 72. This rotation of shaft 65 in turn rotates arm 55 downwardly in the direction indicated by arrow 73. Conversely, as the user moves toggle 61 upwardly within slot 60 in the direction indicated by arrow 75, gear portion 63 rotates downwardly in the direction indicated by arrow 76. The rotation of gear 63 in the direction of arrow 76 rotates gear 64 and shaft 65 in the direction indicated by arrow 77. The rotation of shaft 65 in turn pivots arm 55 upwardly in the direction indicated by arrow 78.

Thus, as the user moves toggle 61 up and down in the directions indicated by arrows 70 and 75, a corresponding punching movement of arm 55 in the directions indicated by arrows 73 and 78 respectively is produced.

Figure 3:
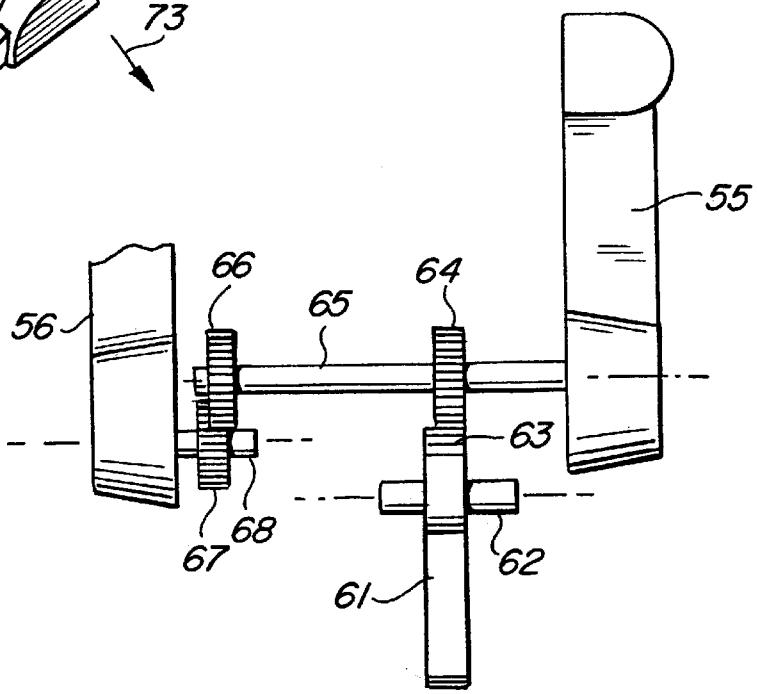
FIG. 3 sets forth a partial perspective view of the punch activating mechanism of the toy figure shown in FIG. 2 taken along section line 3—3 therein.

FIG. 3 sets forth a partial top view of the operative mechanism for toy figure 50. As described above, a toggle 61 is pivotally supported within torso 52 (seen in FIG. 2) by a shaft 62. Toggle 61 includes a gear portion 63. A shaft 65 is rotatably supported within torso 52 (seen in FIG. 1) in accordance with conventional fabrication techniques (not shown). Shaft 65 supports a gear 64 engaging gear portion 63. Shaft 65 further supports arm 55.

Arm 56 is pivotally supported upon torso 52 (torso 52 seen in FIG. 2) by a shaft 68 in accordance with conventional fabrication techniques (not shown). Shaft 68 includes a gear 67 which engages a gear 66 supported upon shaft 65.

In operation, as toggle 61 is pivoted about shaft 62, gear portion 63 rotates correspondingly. The rotational movement of gear portion 63 rotates shaft 65 through the engagement of gear 64. Gear 66 is corresponding rotated by the rotation of shaft 65. With shaft 65 directly coupled to arm 55, arm 55 moves in direct relation to the rotation to shaft 65. The gear coupling between gear 66 and gear 67 however reverses the relative direction of movement between shaft 65 and arm 56. Accordingly, as the user moves toggle 61 about shaft 62, arms 55 and 56 are pivoted in opposite directions. This is the preferred manner of punching action by toy figure 50 (seen in FIG. 1). However, it will be understood that other punching actions and mechanisms may be utilized in toy figure 50 without departing from the spirit and scope of the present invention.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

What is claimed is:

1. A combat simulating toy figure pair comprising:

a first figure having a first torso, a first head, a first pair of arms and a first pair of legs, said first torso defining a slot therein;

arm moving means supported within said first torso having a toggle rotatably supported in said first torso having a gear portion, a pair of shafts supporting said first pair of arms, and gear means coupling said gear portion to said arm shafts;

a second figure having a second torso, a second head, a second pair of arms, a body support supporting said torso an elongated resilient material cape having a bottom edge and a neck ring portion extending from said cape encircling said second head to support said cape upon said second figure, said bottom edge of said cape contacting the surface beneath said second figure when said second figure tips;

a wheel plate supporting said body support and defining a plurality of slots; and a plurality of wheels rotatably supported within said slots, said first figure being manipulated by moving said toggle to punch said second figure and said second figure receiving a punch from said first figure and rolling away from said first figure, and said cape being constructed to prevent tipping of said second toy figure during receipt of a lower force punch yet yielding during receipt of a higher force punch thereby allowing said second toy figure to fall.

* * * * *